US005237545A

United States Patent [19]

Schrader et al.

[11] Patent Number: 5,237,545

[45] Date of Patent: Aug. 17, 1993

[54] ELECTRONIC SIMULATED SUNDIAL TIMEPIECE

[75] Inventors: Paul M. Schrader, 2604 Pioneer Dr., Huntsville, Ala. 35803; Joachim K. Andrew, Harvest, Ala.

[73] Assignee: Paul M. Schrader, Huntsville, Ala.

[21] Appl. No.: 997,890

[22] Filed: Dec. 29, 1992

[51] Int. Cl.[5] ..... G04B 19/00; G04C 19/00; G04C 17/02

[52] U.S. Cl. ..... 368/79; 368/82; 368/240

[58] Field of Search ..... 368/76, 79, 82–84, 368/223, 227, 239–240

[56] References Cited

U.S. PATENT DOCUMENTS 3,832,842 9/1974 Parker ..... 368/82
4,034,549 7/1977 Danley et al. ..... 368/79
4,254,489 3/1981 Azzam ..... 368/84
4,310,909 1/1982 Fujita ..... 368/240

*Primary Examiner*—Vit W. Miska
*Attorney, Agent, or Firm*—Timmons & Kelly

[57] ABSTRACT

An electronic timepiece having a face forming a simulated sundial, a gnomon, a first and second plurality of electronic display circuit elements extending radially from the first and second ends of the base of the gnomon and a control circuit to activate selected display circuit elements to simulate a functioning sundial is disclosed. In one arrangement, the timepiece has a digital auxiliary display and a circuit to convert from the digital display to the selected display circuit elements. The timepiece, in one arrangement, includes a day/night indicator in the form of a solar disk for day and a moon crescent for night.

18 Claims, 20 Drawing Sheets

ELECTRONIC SIMULATED SUNDIAL TIMEPIECE

BACKGROUND OF THE INVENTION

1. Field of the Invention

The present invention relates generally to electronic timepieces and, in particular, to simulated sundials.

2. Description of Related Art

The use of a vertical stick or column to tell time by the shadow cast was known by at least 3500 BCE. The Egyptians developed sundials around 800 BCE. Ahaz, son of Jotham and eleventh king of Judah, developed a sundial in 730 BCE. The sundial was introduced to the Greeks by Anaximander around 520 BCE. In 290 BCE, the Romans captured a sundial in war. For centuries, the sundial has represented modern civilization. In modern times, sundials are primarily used for symbolic value. Sundials have been used for medallions as shown in U.S. Pat. No. Des. 254,733 (Faulkner) and even on watches as shown by U.S. Pat. No. Des. 150,072 (Klaine), U.S. Pat. No. Des. 159,416 (Khan) and U.S. Pat. No. Des. 253,936 (Bova et al.). Each of these designs was, however, intended as an actual, functioning sundial which required the user to correctly orient the sundial wristwatch while outside in the sun. In order to function properly, the gnomon should be inclined at an angle dependent upon the degree of latitude in which it is used. This would mean that each of such watches would only function properly within a narrow range of latitude.

It was not until 1967 that the atomic second replaced the solar second as the time standard. Two years later, Seiko of Japan introduced the first electronic wristwatch. Texas Instruments and Eubauches S.A. together marketed the first liquid crystal digital display timepiece in 1972.

U.S. Pat. No. 4,355,380 (Huguenin et al.) shows a wristwatch with separate displays that are actuated at different times of the day in addition to showing a combination of digital display and a traditional analog watch.

SUMMARY OF THE INVENTION

The present invention is an electronic timepiece which gives the appearance of an actually functioning sundial, having a face which simulates a sundial with representations of hours visible in appropriate locations, a gnomon forming a visible line on the simulated sundial, a first plurality of substantially linear electronic display circuit elements on the simulated sundial along lines extending radially from one end of the line formed by the gnomon toward the portion of the sundial representing the hours, a second plurality of substantially linear electronic display circuit elements on the simulated sundial along lines extending radially from the other end of the line formed by the gnomon toward the portion of the sundial representing the hours, and a control circuit. The control circuit actuates display circuit elements and where the first and second substantially linear electronic display circuit elements overlap at a given time, they form a visible triangle which terminates nearest the position on the portion of the sundial with the representations of the hours which represents the actual time.

In one preferred form, the electronic timepiece also includes a digital auxiliary display on the face of the timepiece. Such a digital display would include digital representations for minutes, tens of minutes, hours and tens of hours. It can, of course, also include digital representations for seconds and tens of seconds or any other units. In one such an arrangement, the control circuit includes a conventional timepiece circuit for actuating the digital auxiliary display, and a conversion circuit and a reset circuit, both responsive to the time represented on the digital auxiliary display for actuating the corresponding elements of the first and second pluralities to represent approximately the same time as actuated on the digital auxiliary display. The conversion circuit, in a preferred form, converts the representations of hours and tens of hours on the digital display into twelve outputs representing the hours of one through twelve. Similarly, it converts the tens of minutes into six outputs representing zero, ten, twenty, thirty, forty and fifty minutes after the hour. The conversion circuit also includes a circuit for selecting which display circuit elements from each of the first and second pluralities to actuate and make a fully visible display based on outputs for hours and tens of minutes.

In one electronic timepiece according to the present invention, each display circuit element of the first plurality is etched into a bottom layer ground circuit, and each display circuit element of the second plurality is etched into a top layer positive circuit. Liquid crystal is dispersed in a middle layer. The display is actuated by substantially grounding display circuit elements from the first plurality which would fall in the gnomon "shadow" and driving with a positive voltage display circuit elements from the second plurality which would fall within the gnomon "shadow." Where the positive display circuit elements of the second plurality overlap the grounded display circuit elements of the first plurality will visibly illuminate a basically triangular display with one angle pointing toward a position on the portion of the sundial with representations of the hours, which position substantially represents the actual time.

An electronic timepiece according to the present invention, in one embodiment, further includes a visual indicator of whether the time is day or night. In one arrangement, the visual indicator displays a crescent image to represent night and a substantially round solar image to represent day.

These and other objects, advantages and features of this invention will be apparent from the following description taken with reference to the accompanying drawing, wherein is shown the preferred embodiments of the invention.

DESCRIPTION OF THE PREFERRED EMBODIMENT

Figure 1:
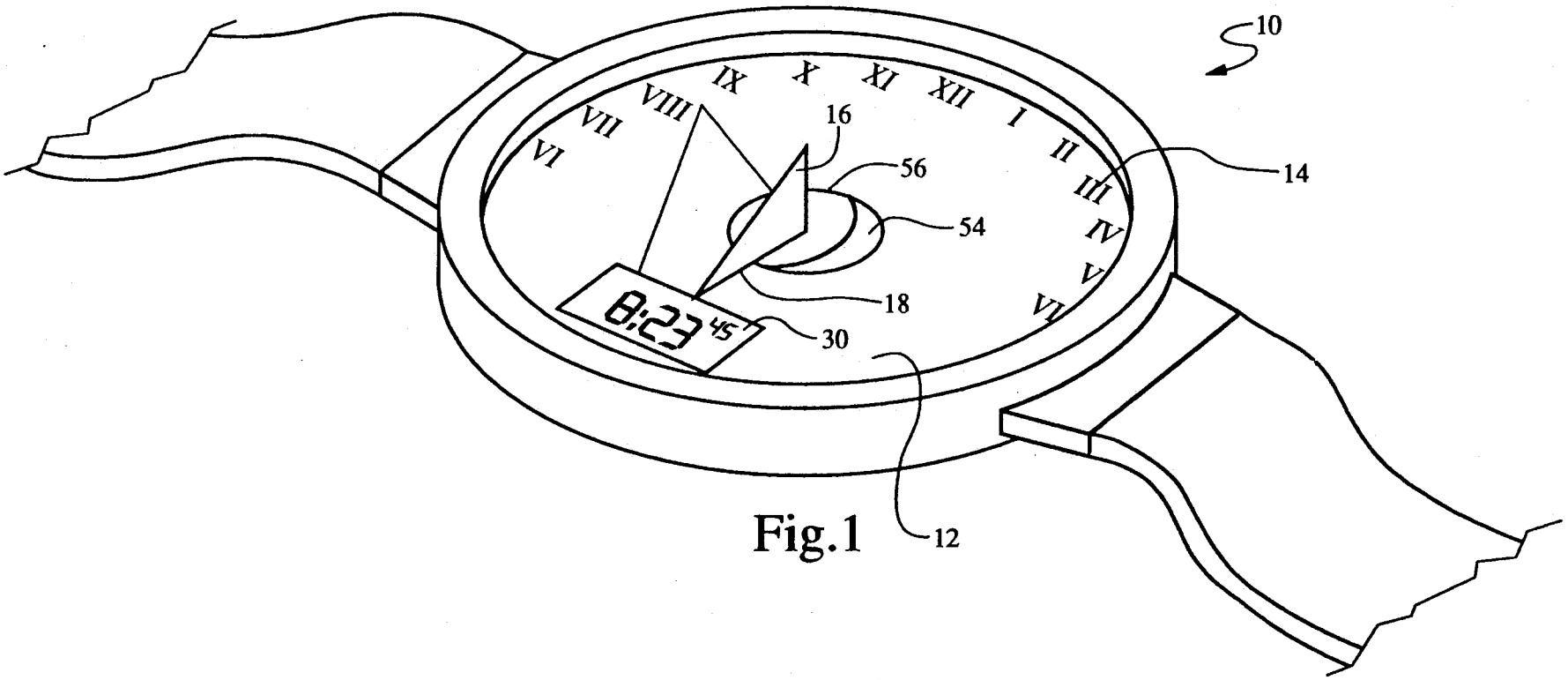
FIG. 1 is pictorial representation of an electronic timepiece according to the present invention.

Referring now to the drawing, and in particular to FIG. 1, a timepiece according to the present invention is referred to generally by reference numeral 10. Timepiece 10 includes a face 12 forming a simulated sundial with representations 14 of hours visible in appropriate locations, and a gnomon 16 forming a line 18, visible at least in part on the simulated sundial. Gnomon 16 can be actual or virtual, the visible portion of line 18 being generated electronically or simply being drawn on face 12.

Figure 2:
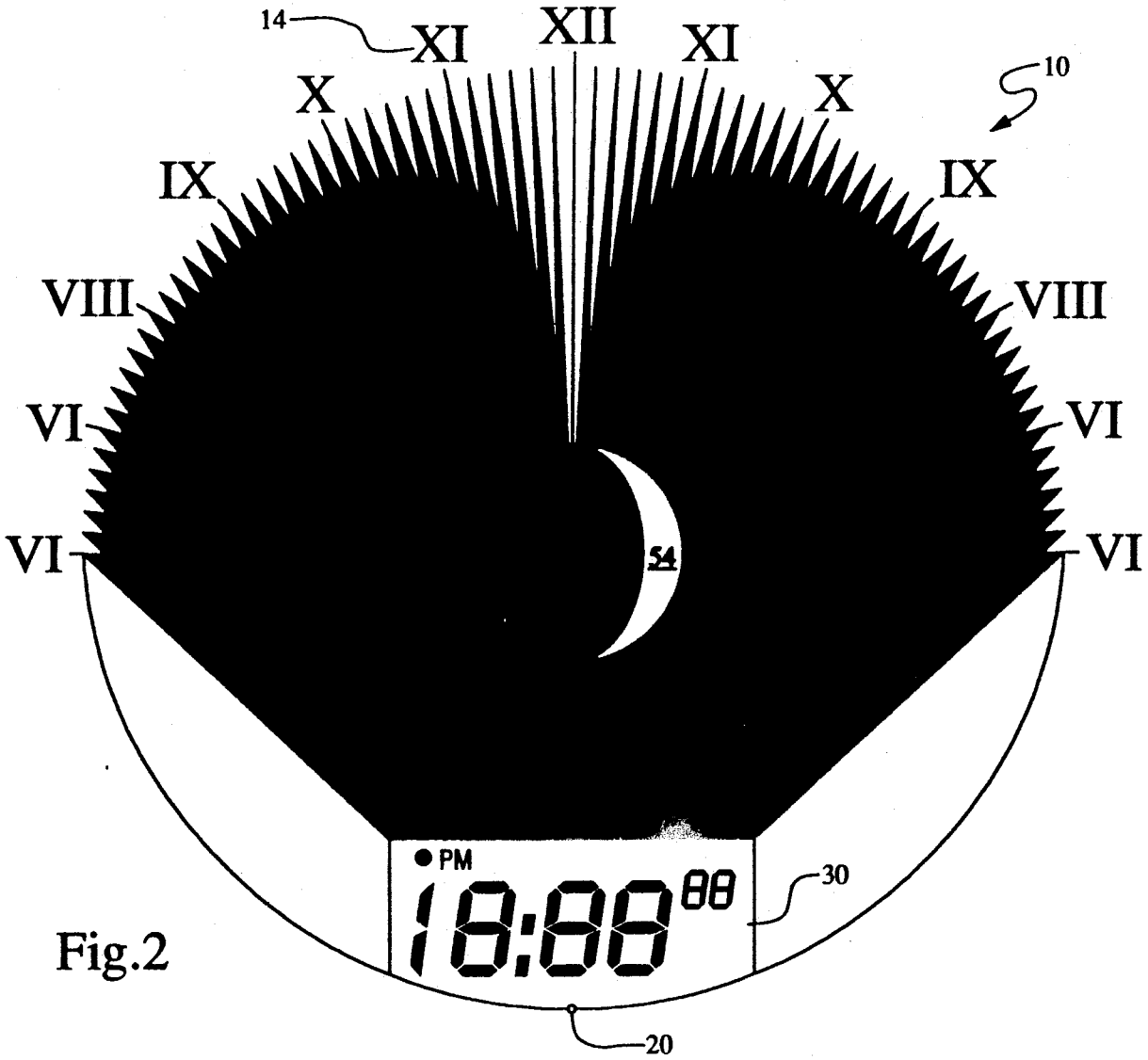
FIG. 2 is a front elevational view of the electronic timepiece of FIG. 1 with all electronic display circuit elements shown.
Figure 3:
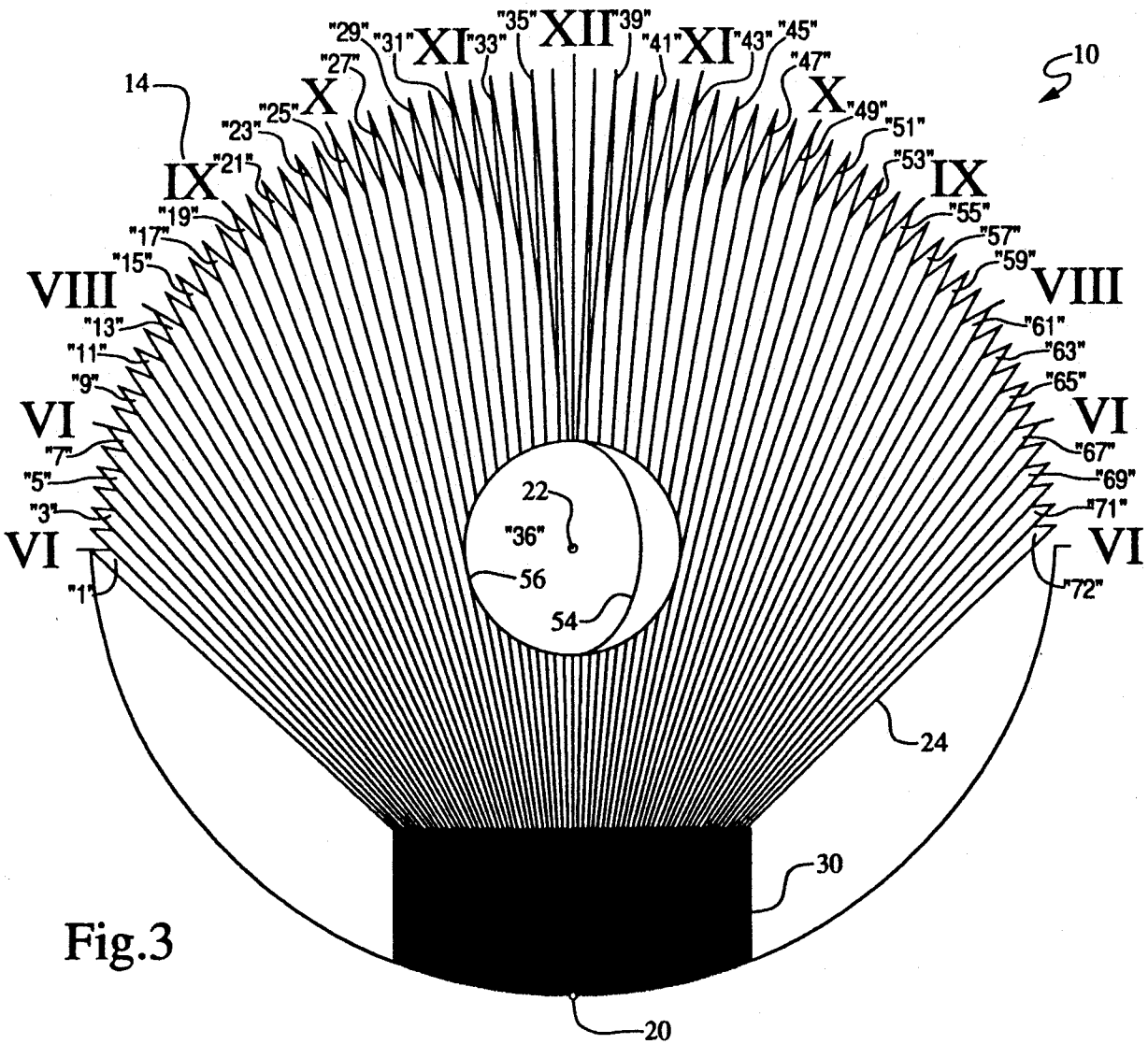
FIG. 3 is a front elevational view thereof with all negative or grounded electronic display circuit elements shown.
Figure 4:
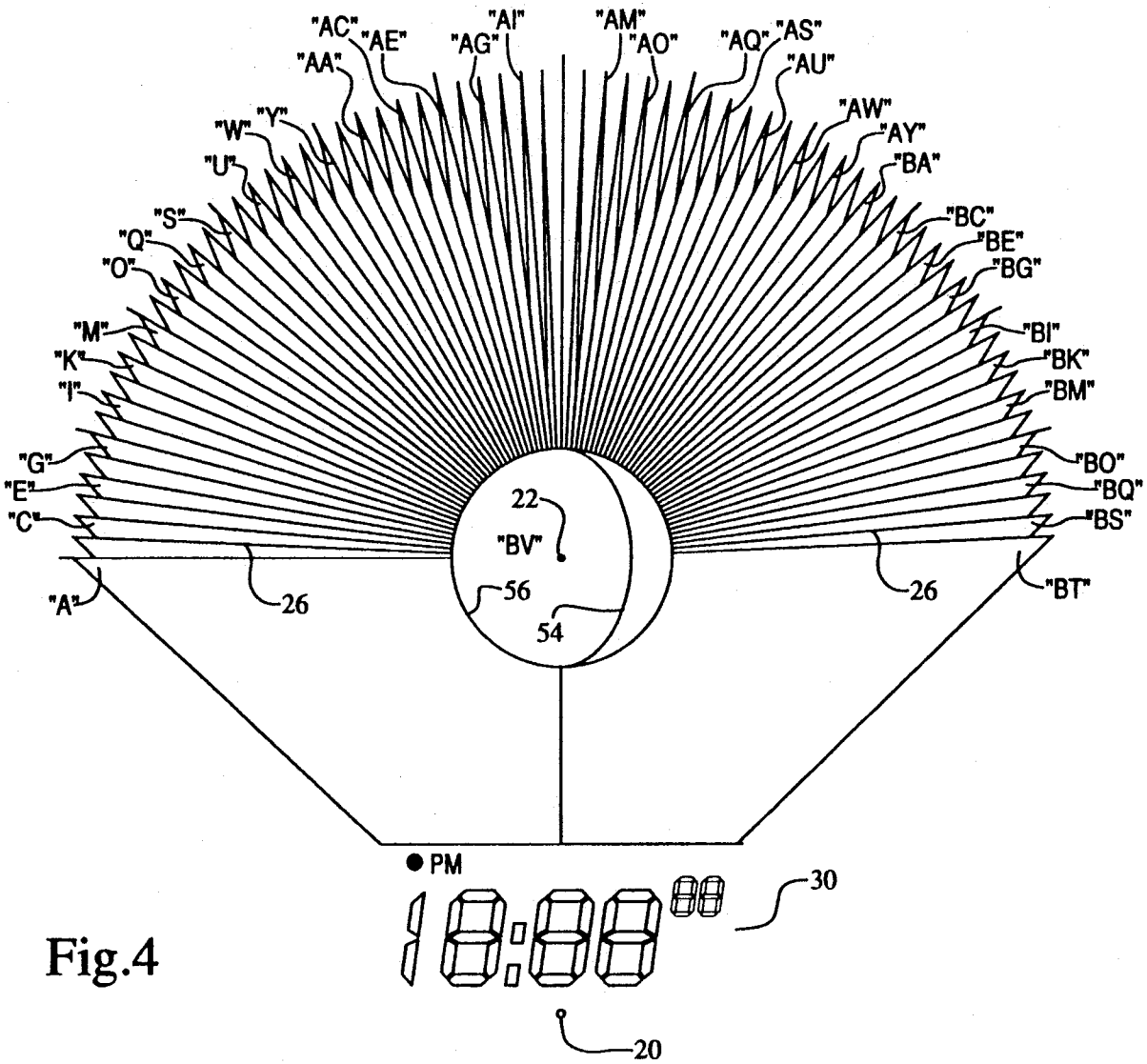
FIG. 4 is a front elevational view thereof with all positive electronic display circuit elements shown.

Referring also to FIGS. 2, 3 and 4, line 18 has a first end 20 and a second end 22. A first plurality of substantially linear electronic display circuit elements 24 on the simulated sundial, extend radially along lines from the first end of the line formed by gnomon 16 toward the portion of the sundial with representations 14 of the hours. A second plurality of substantially linear electronic display circuit elements 26 on the simulated sundial, extend radially along lines from second end 22 of the line formed by the gnomon toward the portion of the sundial with the representations of the hours. Display between overlapping circuit elements 24 and 26 can be liquid crystal display or light emitting diodes or any other display circuit elements. If made of liquid crystal, then there are three layers, a positive layer made up of display circuit elements 26 and a ground layer made up of display circuit elements 24, with a middle layer of dispersed liquid crystal.

Figure 5:
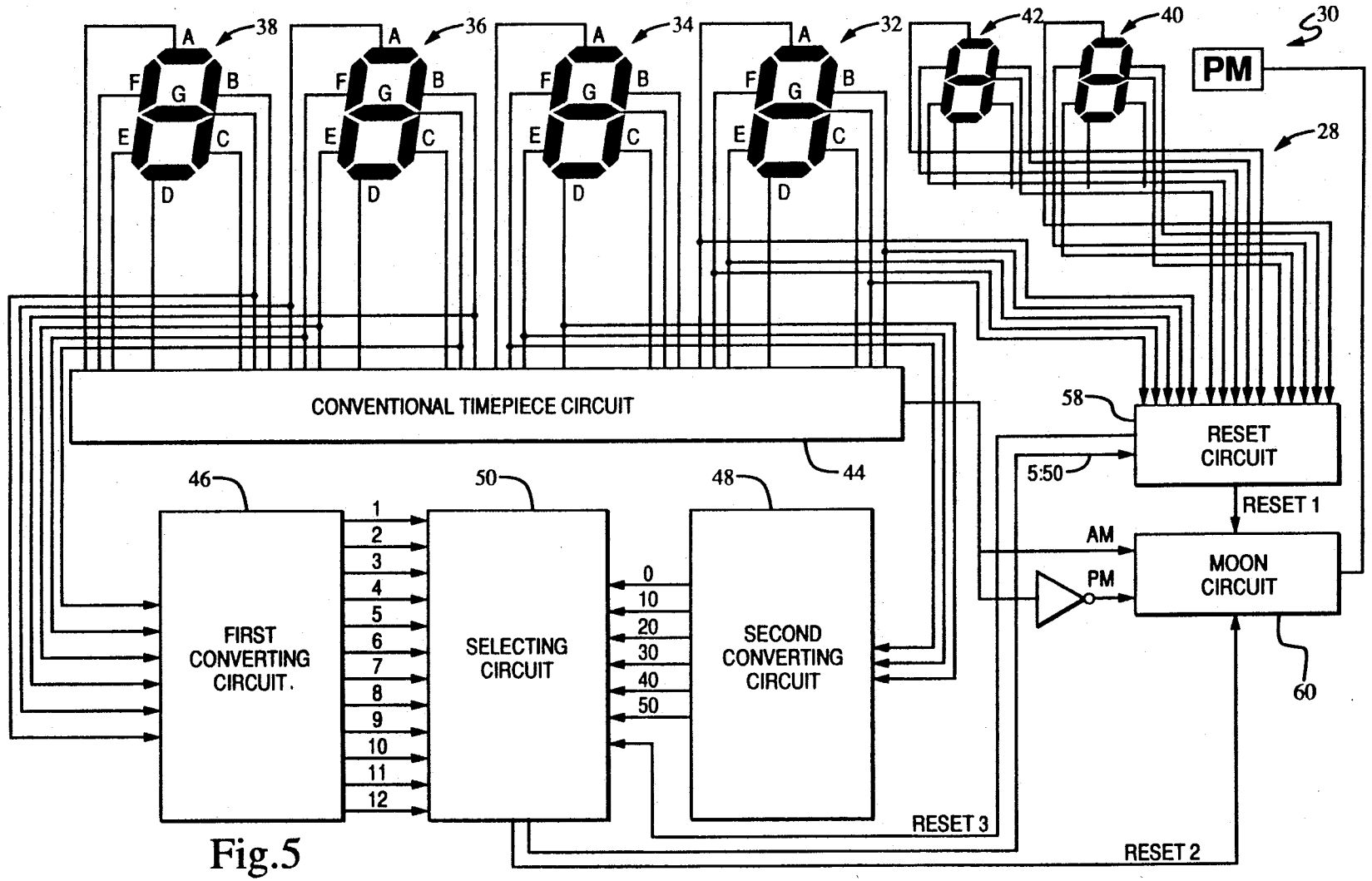
FIG. 5 is a front elevational view of a digital auxiliary display and partial block diagram representation of a control circuit according to the present invention.

Referring now to FIG. 5, a control circuit 28 actuates display circuit elements 24 from the first plurality and display circuit elements 26 from the second plurality and makes a fully visible display which terminates nearest the position on the portion of the sundial with the representations of the hours which portion substantially represents the actual time. The activated elements meet or at least appear to meet in a point and act cooperatively with the gnomon to form a triangular display pointing to substantially the correct time and give the appearance of an actually functioning sundial.

A digital auxiliary display 30 is visible on face 12 and has separate digital representations 32, 34, 36 and 38 for minutes, tens of minutes, hours and tens of hours respectively. Digital display 30 also has separate digital representations 40 and 42 for seconds and tens of seconds respectively. A normal digital representation includes seven linear display circuit elements, which, for purposes of illustration shown on digital representation 38, can be lettered beginning with "A" as the top horizontal display circuit element and lettering clockwise to "F". The middle horizontal display circuit element is thus "G". In order to completely "read" the digital display, it is only necessary to know the state of the following:

HOURS/TEN: Segment C

HOURS/ONE: Segments A, B, E, F, G

MINUTES/TEN: Segments D, E, F

The remaining digital representations 32, 42 and 40 need A, B, E, F and G as a minimum.

Figure 6:
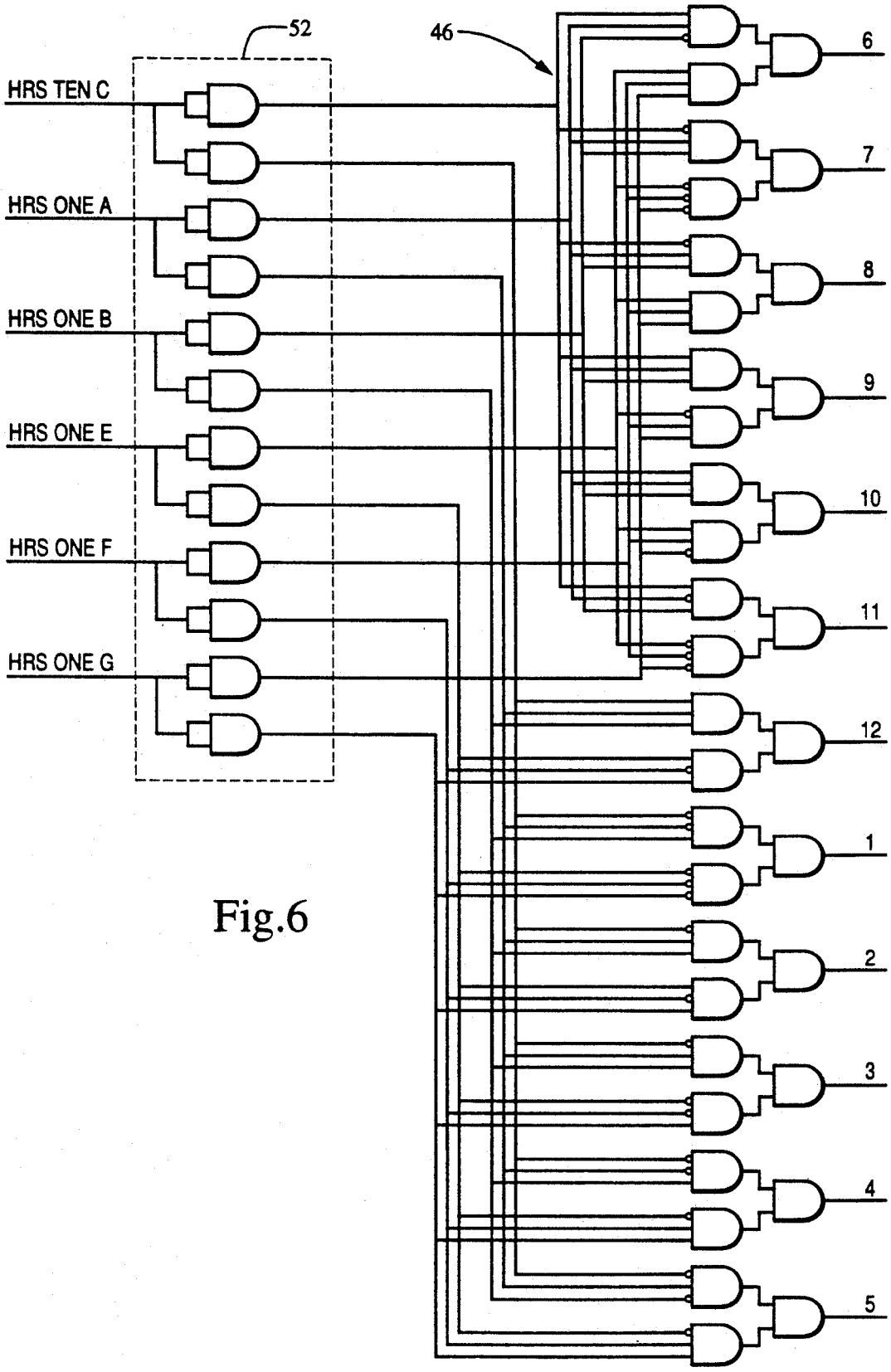
FIG. 6 is a diagram of a circuit for converting hours and tens of hours into twelve outputs representing the hours of one through twelve.
Figure 7:
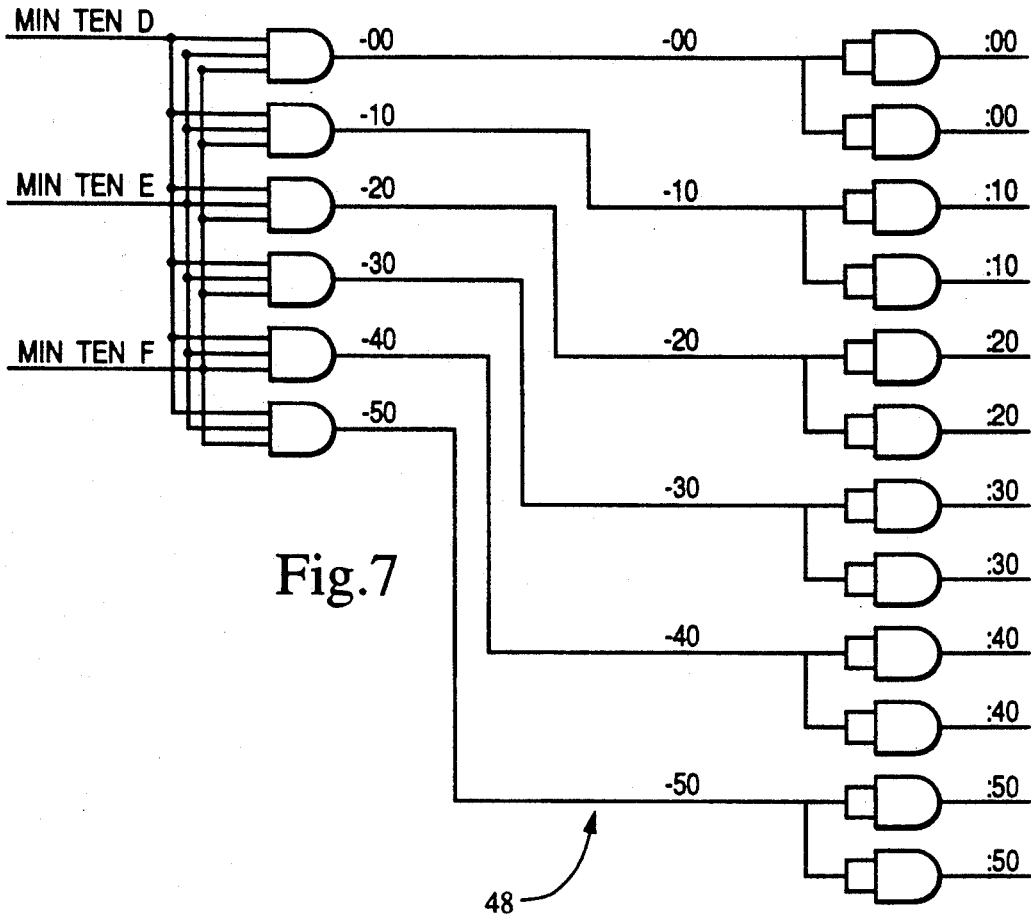
FIG. 7 is a diagram of a circuit for converting the representation of tens of minutes into six outputs representing zero, ten, twenty, thirty, forty and fifty minutes after the hour.

Control circuit 28 includes a conventional timepiece circuit 44 of a kind which is well known in the art for actuating the digital display to represent time, and a conversion circuit responsive to the time represented on digital display 30 for actuating the corresponding elements of the first and second pluralities to represent approximately the same time as actuated on the digital display. The conversion circuit includes a first circuit 46 for converting the representations of hours and tens of hours into twelve outputs representing the hours of one through twelve, as shown in FIG. 6, a second circuit 48 for converting the representation of tens of minutes into six outputs representing zero, ten, twenty, thirty, forty and fifty minutes after the hour, as shown in FIG. 7, and a circuit 50 for selecting which display circuit element from each of the first and second pluralities to actuate and make fully visible based on outputs from the first and second circuits for converting. Circuit 50 is shown more clearly in FIG. 8 (*a*) through (*l*).

In a preferred arrangement, each element 24 of the first plurality terminates near the termination of one element 26 of the second plurality wherein the pair of elements forms a point at the ends of the elements opposite gnomon 16 by substantially grounding the gnomon end of one element of the pair and driving the gnomon end of the second element of the pair at a voltage greater than zero in absolute value. For purposes of illustration only, display circuit elements 24 have been numbered clockwise "1" through "72" and display circuit elements 26 have been lettered clockwise "A" through "BT". As an example, element "A" is connected to element "1" at the end opposite the gnomon, and, similarly, element "B" is connected to element "2". At 6 o'clock, the C element of digital representation 38 for tens of hours is zero; for digital representation 36 for hours, elements A, E, F and G are all on (high) as inputs to buffer stage 52 of first converting circuit 46. Digital representation 34 for tens of minutes will have all display circuit elements off (low) at the input of second converting circuit 48, making the output of circuit 48 high for :00 and low for all other values. Lead "6" is selected from first converting circuit 46 and lead "00" is selected from second converting circuit 48. Leads "6" and "00" are input to the first stage of selecting circuit 50 as shown in FIG. 8 (*a*), selecting high for element "A". Both a ground and a positive element are actuated by selecting circuit 50, except for 6:00 and 12:00, referring to FIGS. 8(*a*) through 8(*l*).

Figure 9:
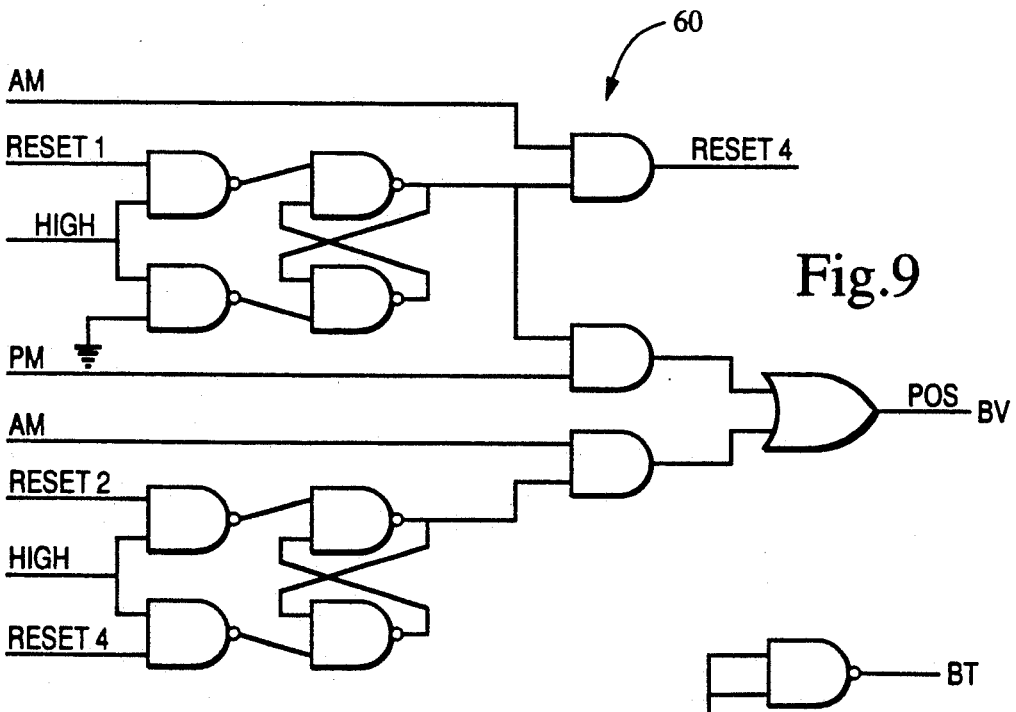
FIG. 9 is a diagram of a circuit for actuating a visual indicator of whether the time displayed is day or night.
Figure 10:
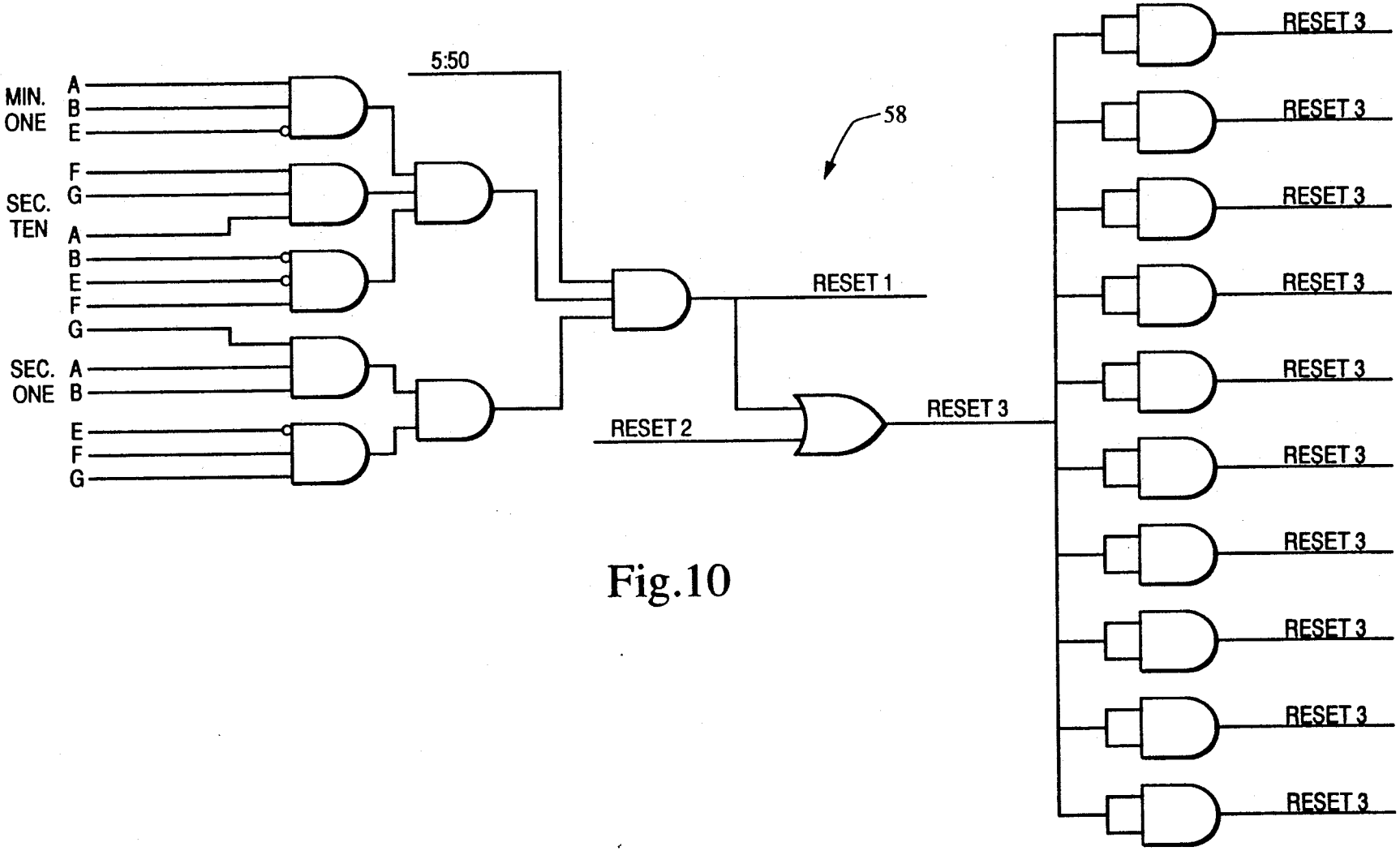
FIG. 10 is a diagram of a reset circuit for the present invention.

An electronic timepiece according to one arrangement further includes a visual indicator of whether the time is day or night, such as an electronic representation 54 of a moon crescent to represent night. A substantially round solar image 56 represents day. Referring to FIG. 9 and FIG. 10, reset circuit 58 and moon circuit 60 select the moon crescent image or the round solar image to display.

Figure 11:
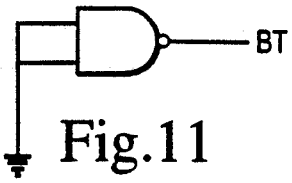
FIG. 11 is a diagram of a circuit for positive circuit display element BT.
Figure 8A:
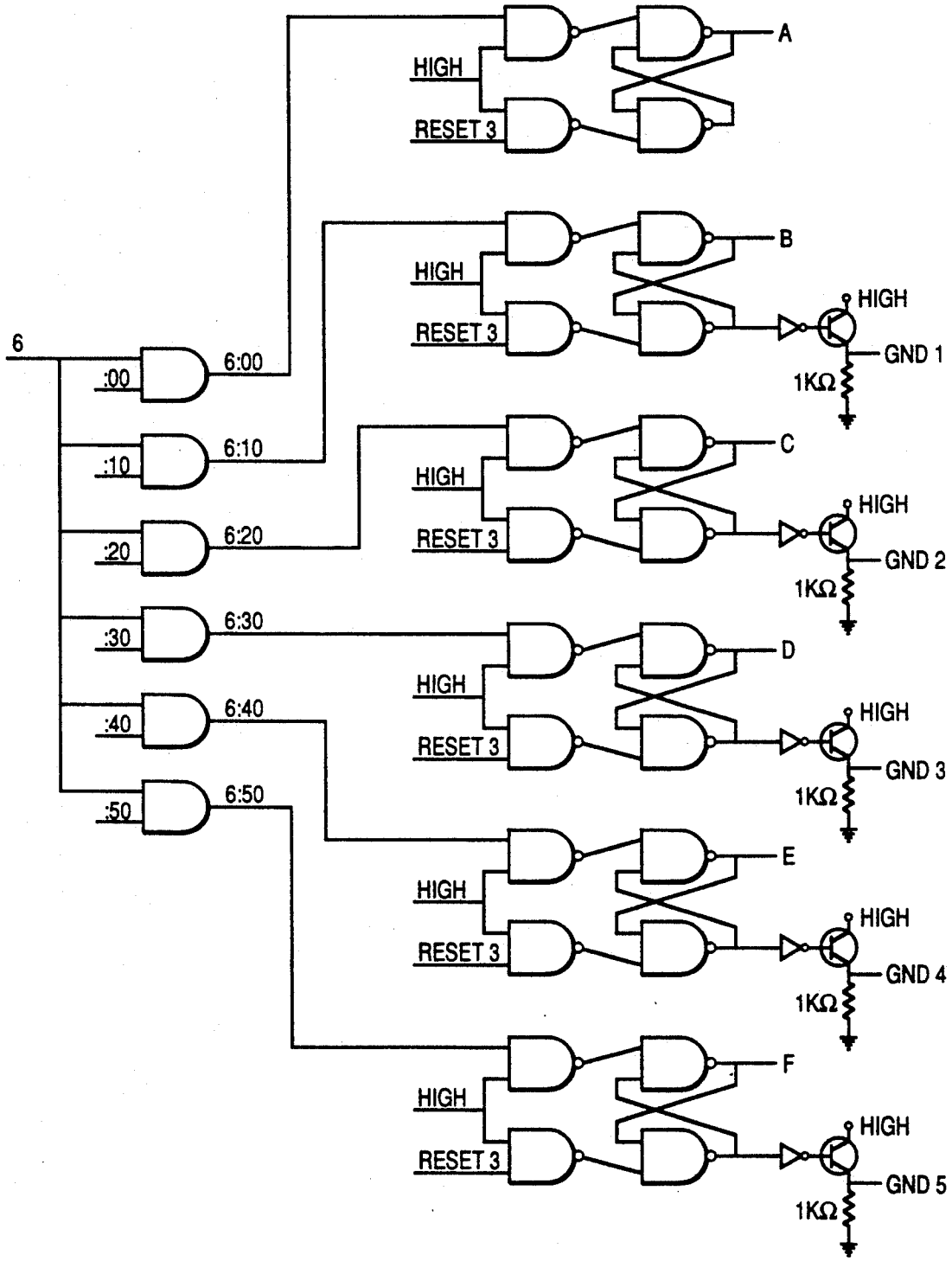
FIG. 8 (*a*) through (*l*) is a diagram of a circuit for selecting which display circuit element to select from each of the first and second pluralities of display circuit elements to actuate and make a fully visible display.
Figure 8B:
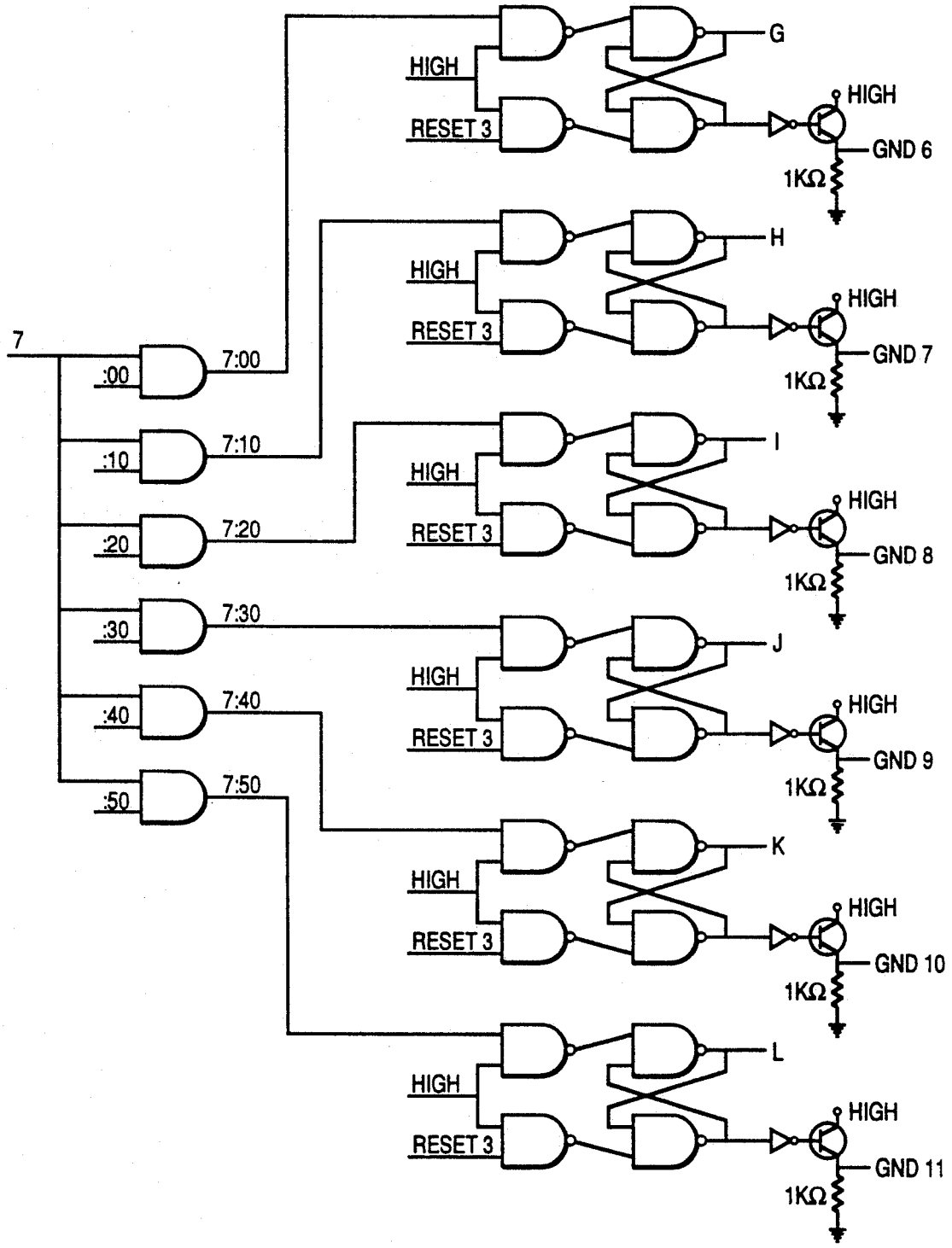
Figure 8C:
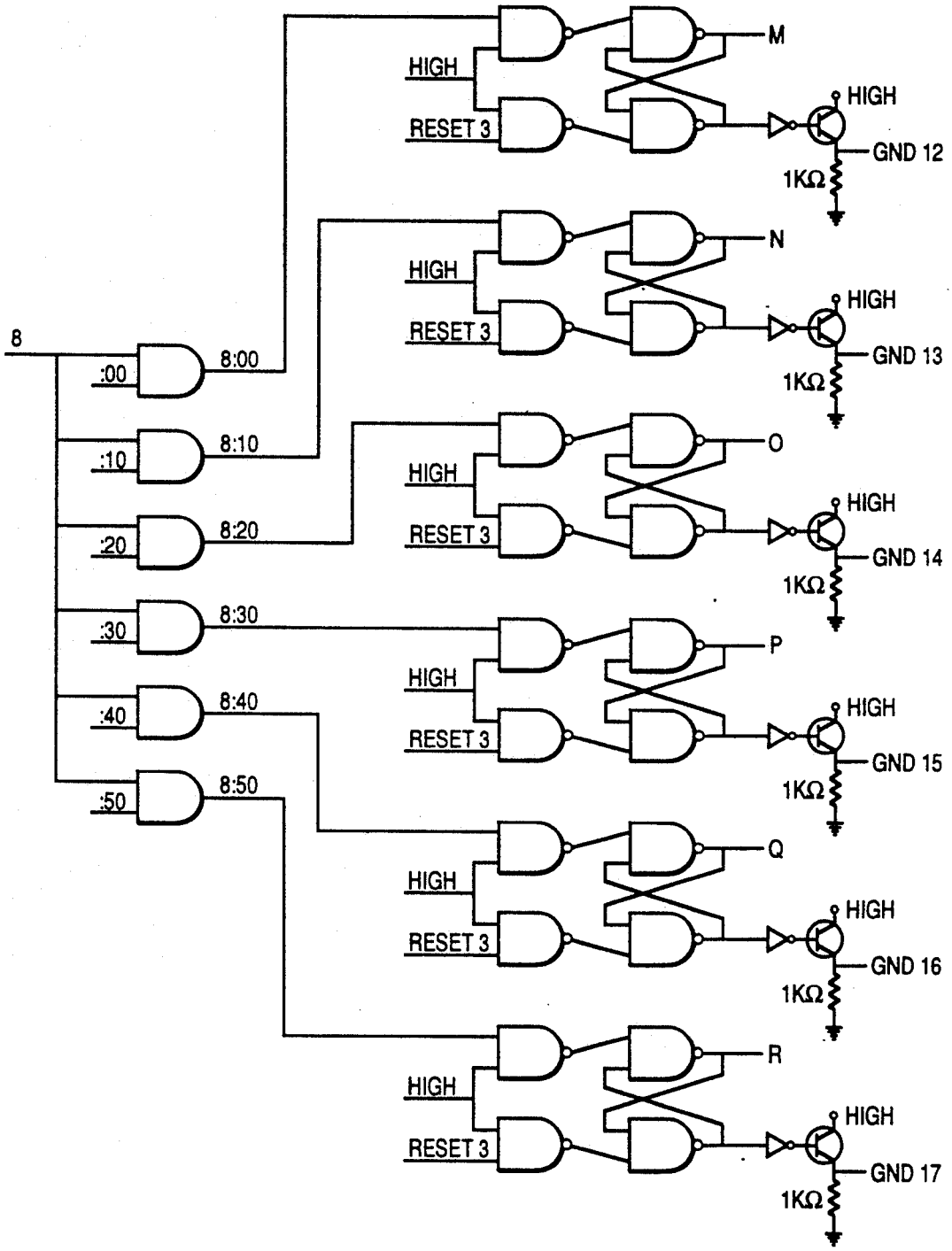
Figure 8D:
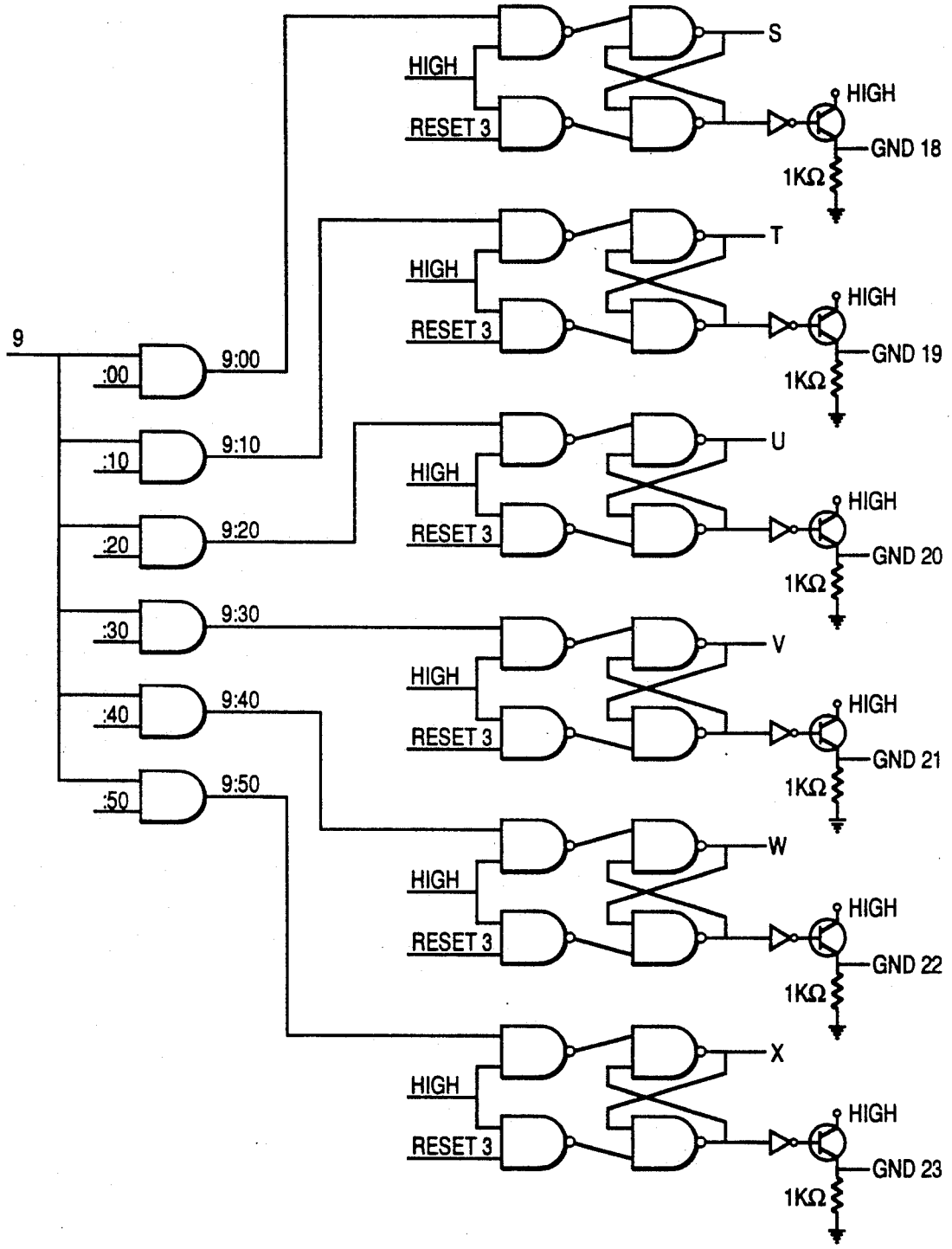
Figure 8E:
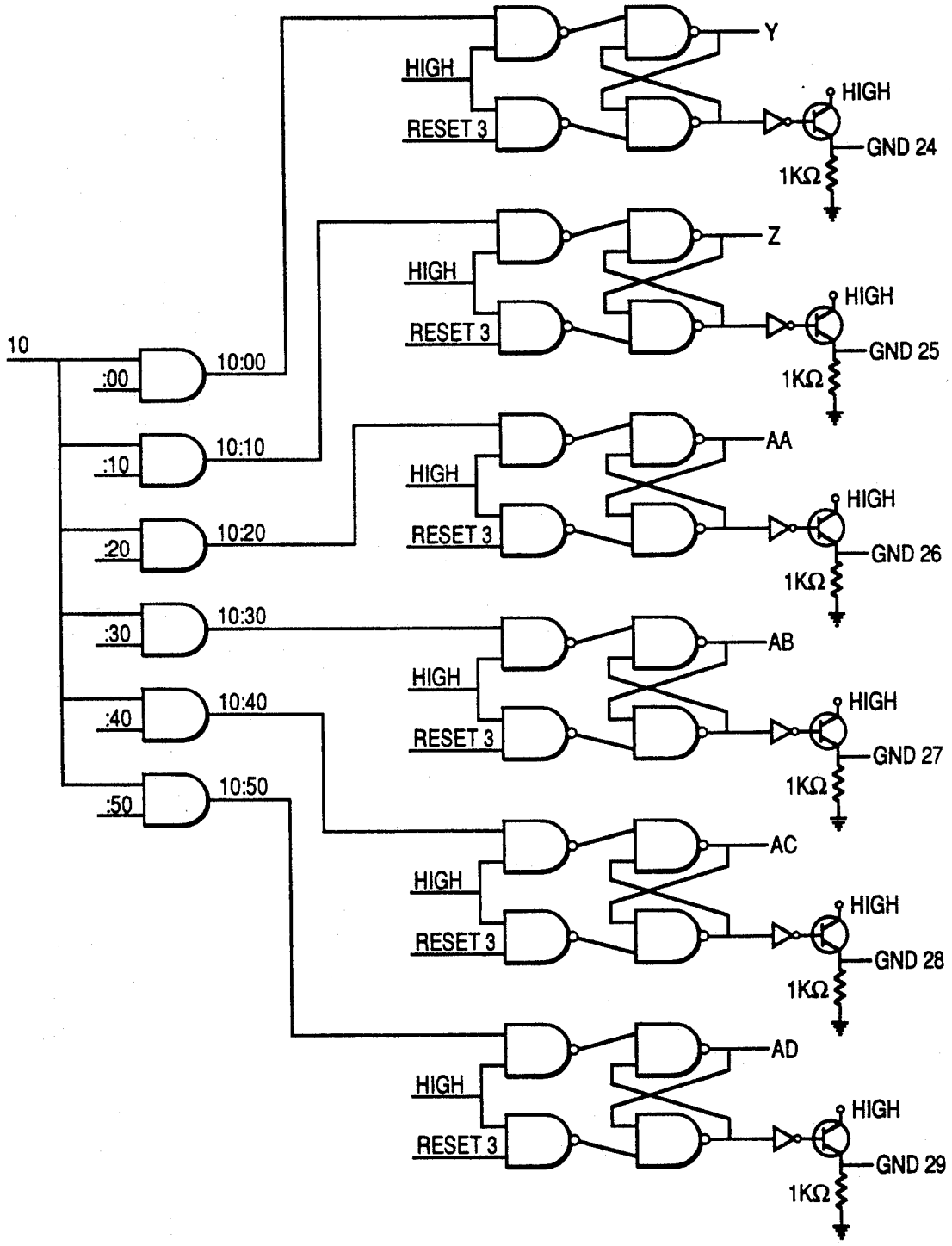
Figure 8F:
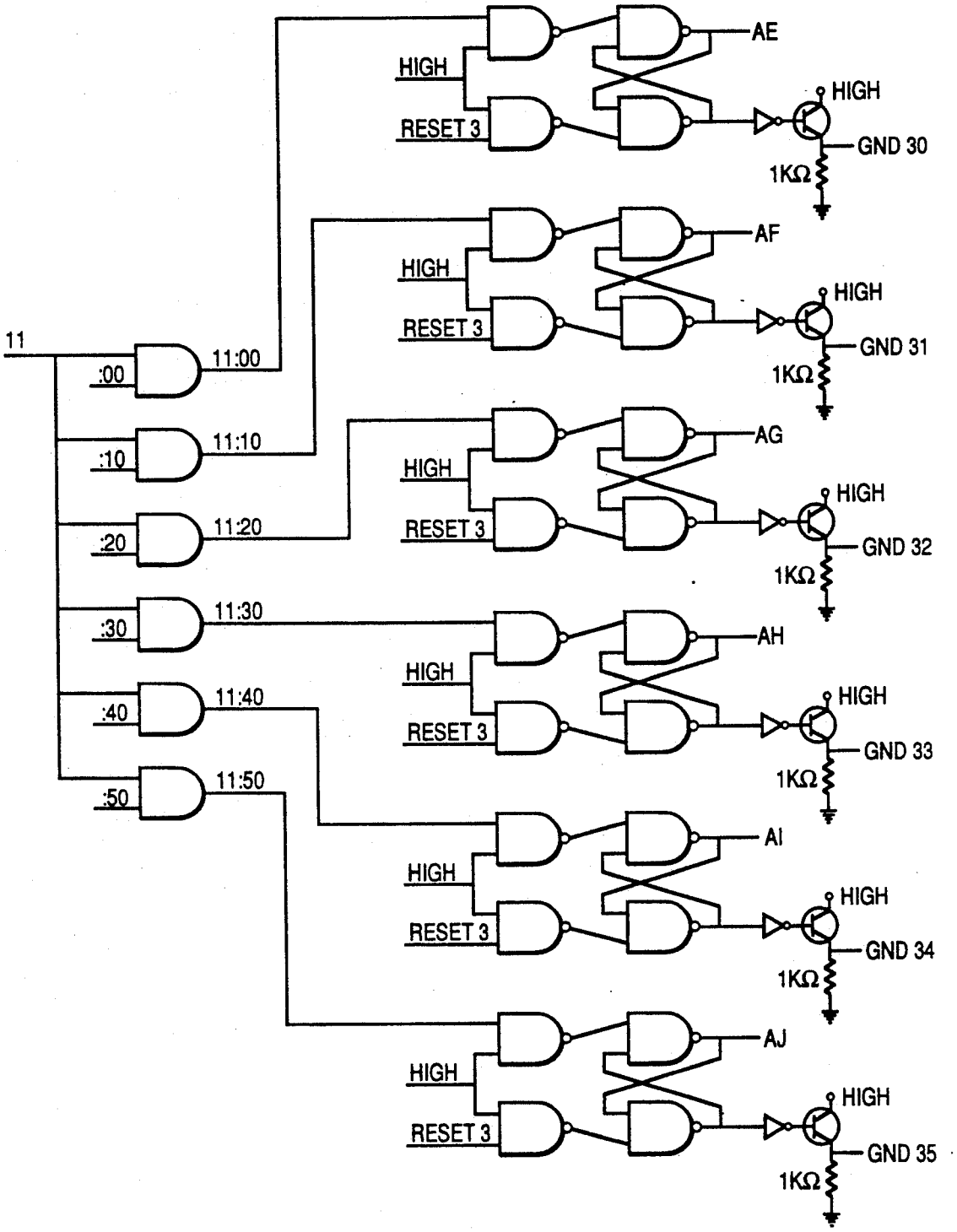
Figure 8G:
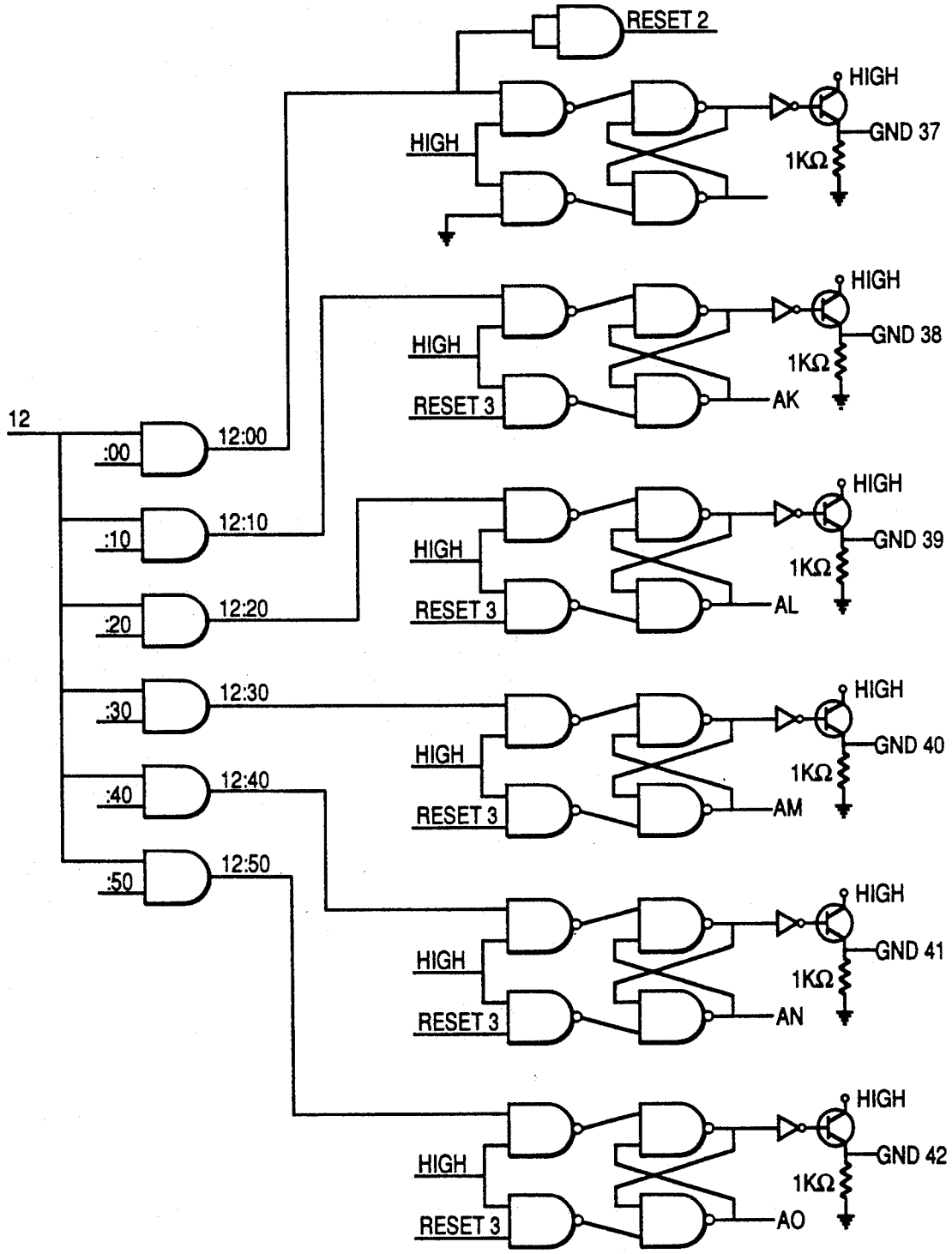
Figure 8H:
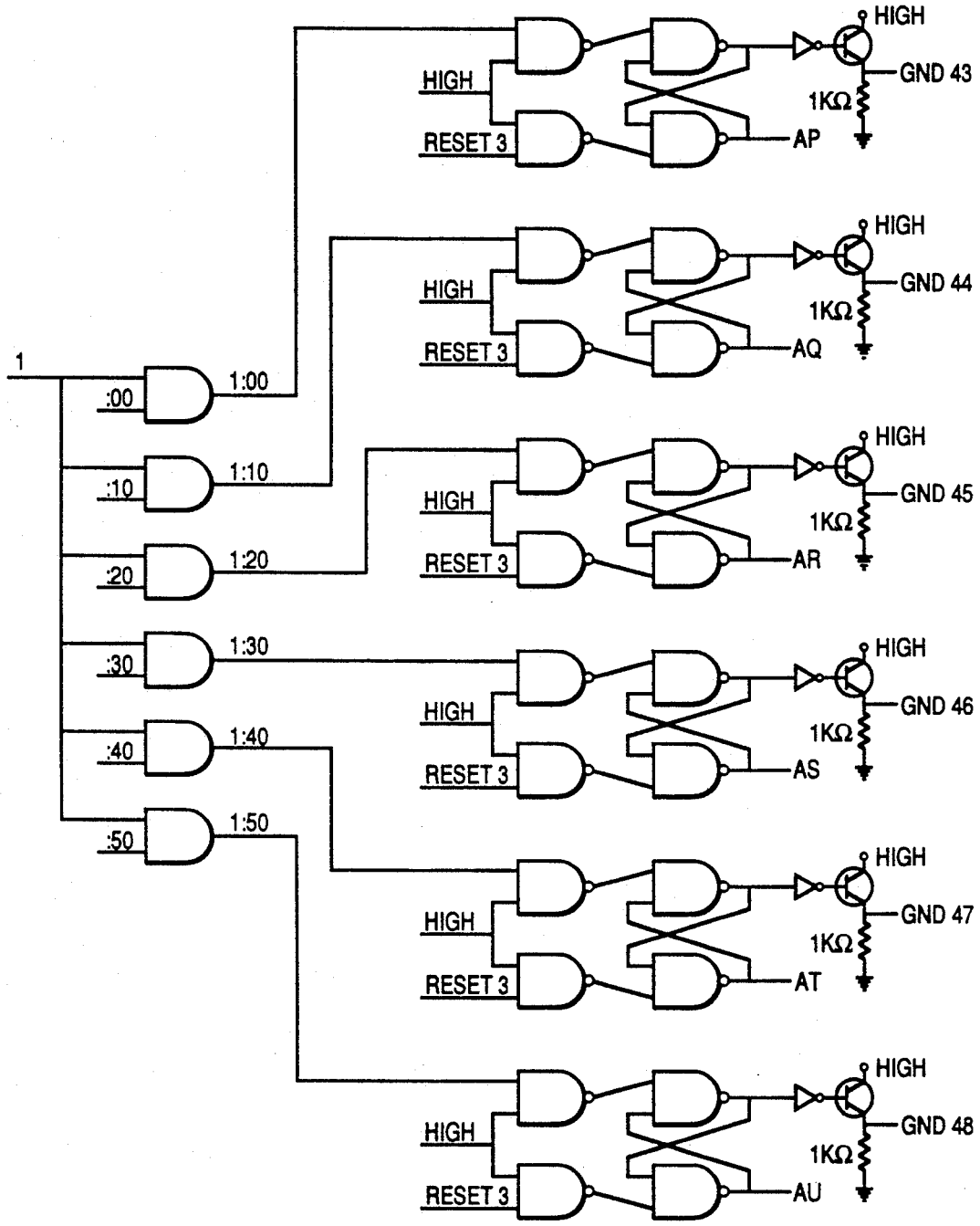
Figure 8I:
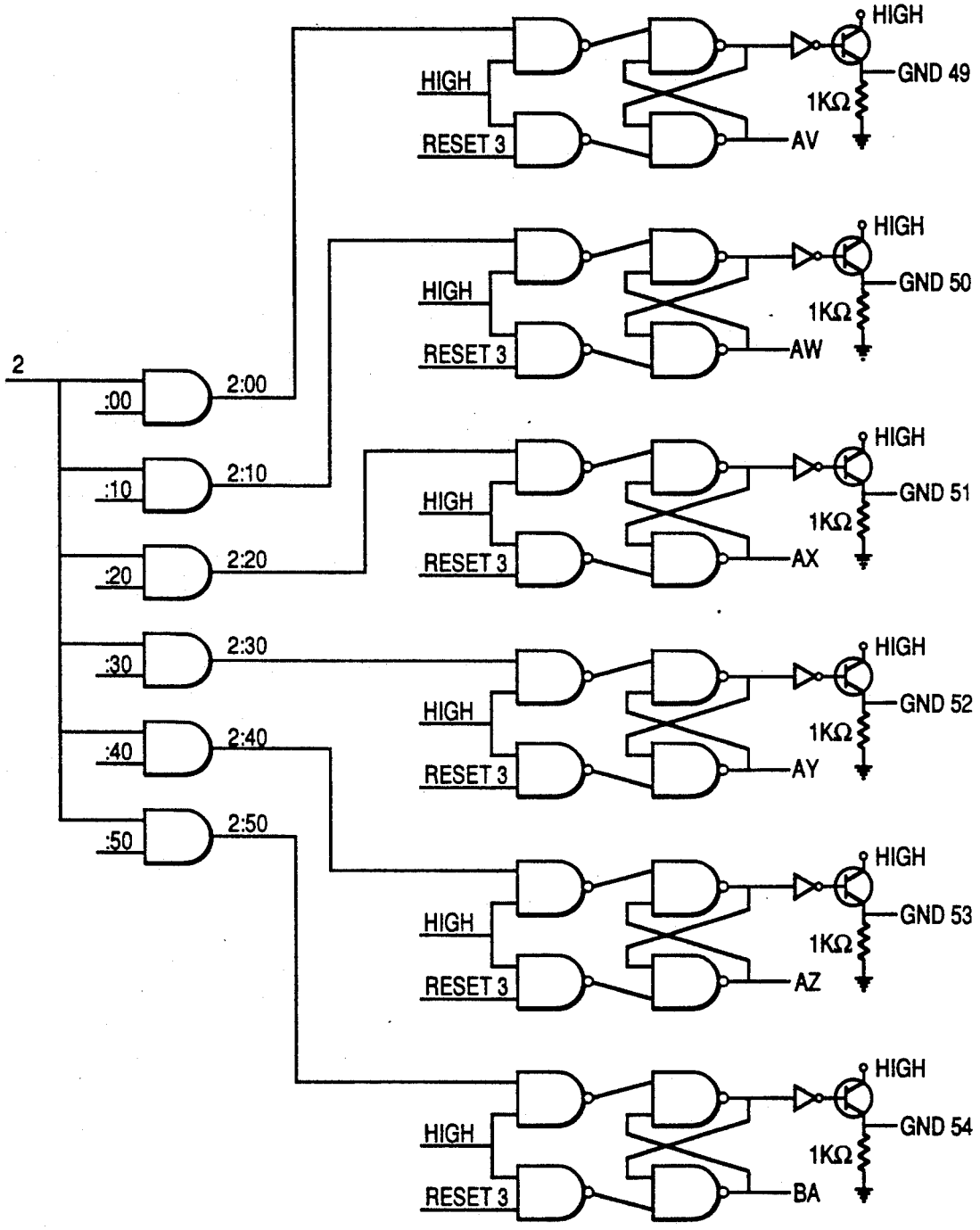
Figure 8J:
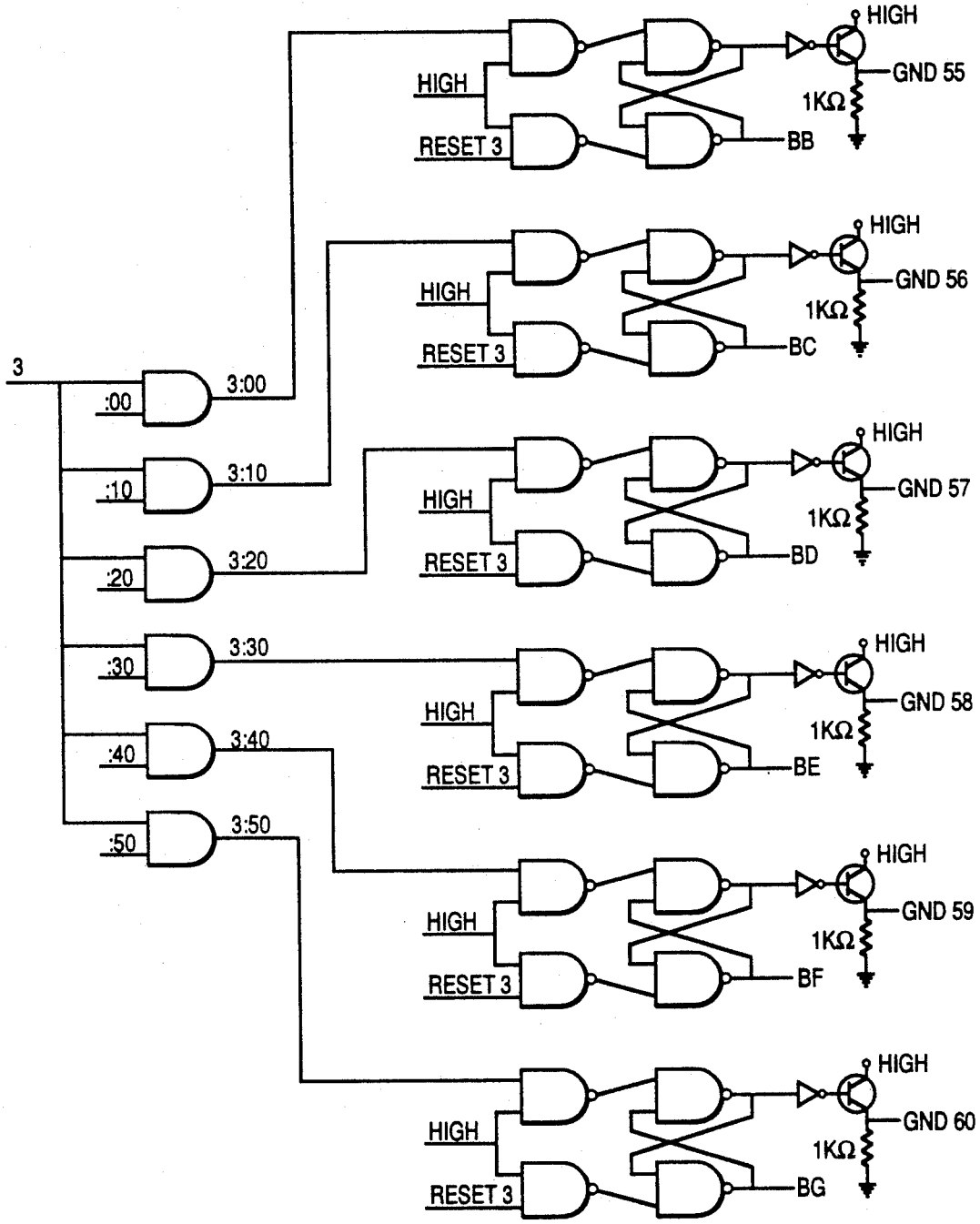
Figure 8K:
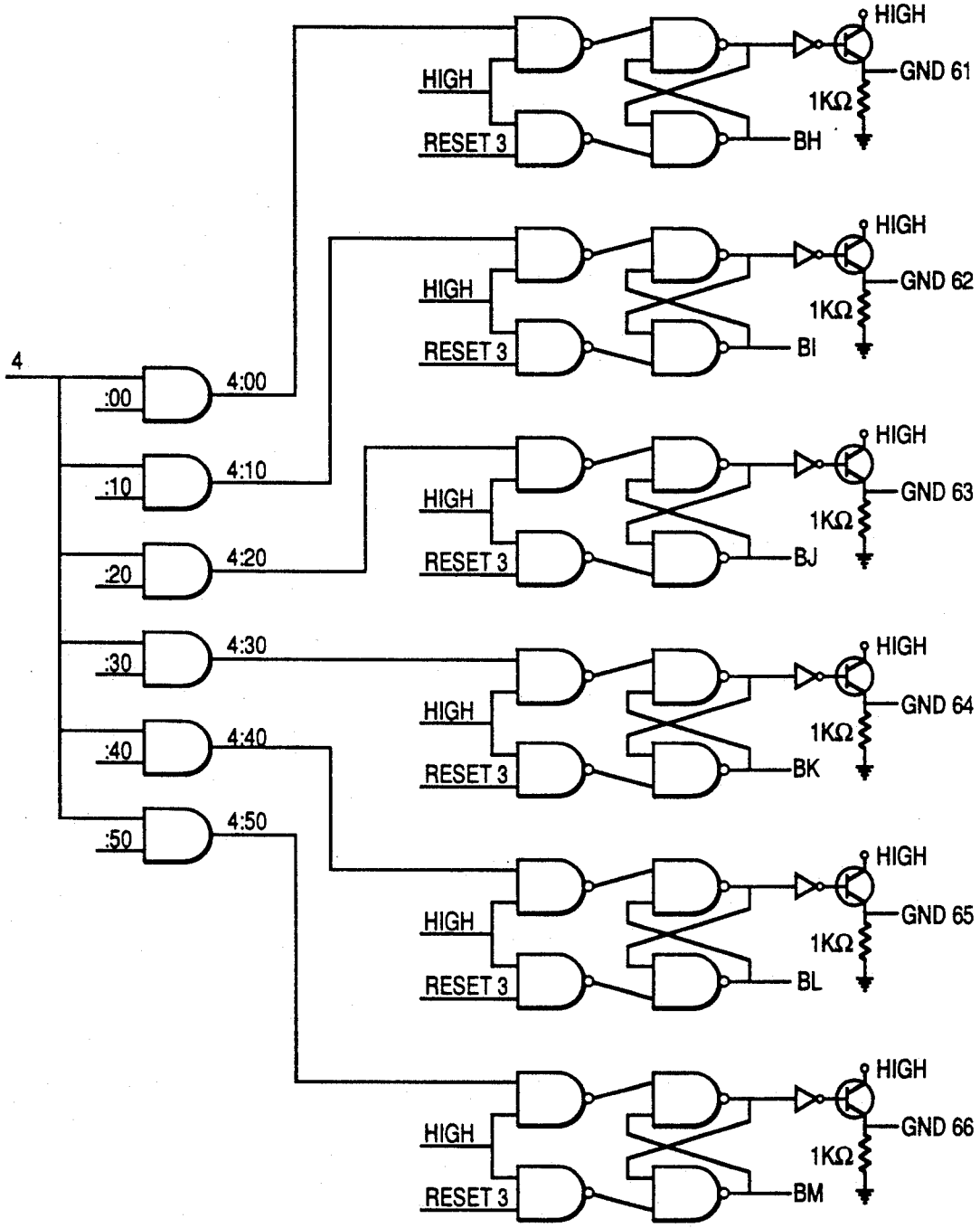
Figure 81:
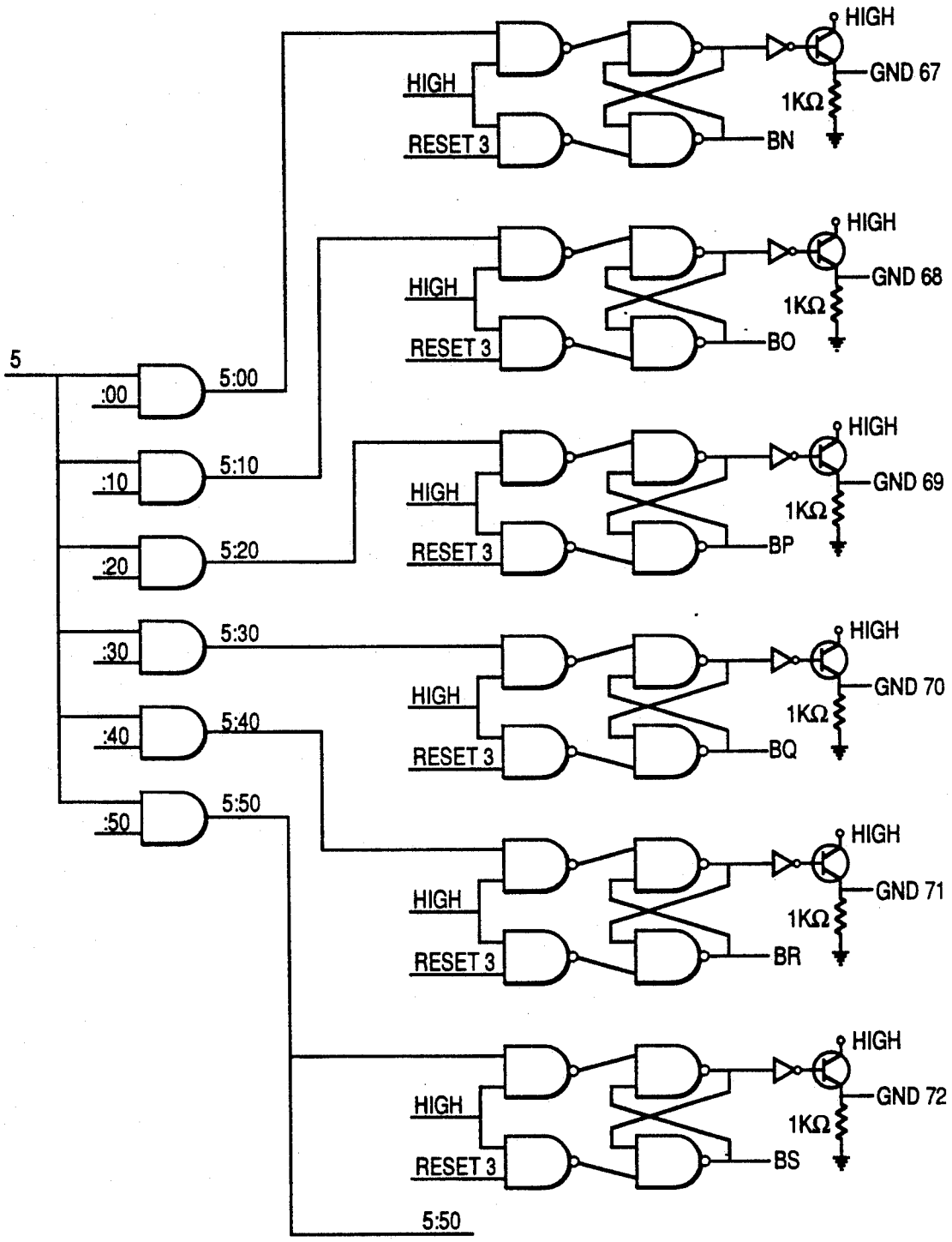

Referring to FIG. 4 and FIG. 11, right most positive display circuit element BT is held in a high position. Referring again to FIG. 3, circuit display element "36" is both the time segment for 11:50 and the ground circuit element for the moon display.

EXAMPLE 1

At 5:59:59

Reset 1 at 5:59:59 activates reset 3.

Reset 3 turns:

1. positive segments A through AJ off.
2. positive segments AK through BS on.
3. ground segments "1" through "36" on.
4. ground segments "38" through "72" off.

At 6:00

Positive segment A is turned on.

At 6:10

1. positive segment B is turned on.
2. negative segment "1" is turned off.

Every 10 minutes thereafter, the next successive positive segment is turned on, and the next successive negative segment is turned off. This continues through 11:50.

EXAMPLE 2

At 12:00

Reset 2 activates reset 3.

Reset 3 turns:

1. positive segments A through AJ off.
2. positive segments AK through BS on.
3. ground segments "1" through "36" on.
4. ground segments "38" through "72" off.

12:00 circuit turns ground segment "37" on.

At 12:10

Ground segment "37" goes off because 12:00 circuit is no longer activated.

1. positive segment AK is turned off.
2. ground segment "38" is turned on.

At 12:20

1. positive segment AL is turned off.
2. ground segment "39" is turned on.

Every 10 minutes thereafter, the next successive positive segment is turned off, and the next successive ground segment is turned on. This continues through 5:50. At 5:59:59, reset 1 activates reset 3, and the cycle is repeated.

From the foregoing it will be seen that this invention is one well adapted to attain all of the ends and objects hereinabove set forth, together with other advantages which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the figures of the accompanying drawing is to be interpreted as illustrative and not in a limiting sense.

We claim:

1. An electronic timepiece comprising in combination:

a face forming a simulated sundial with representations of hours visible in appropriate locations;

a gnomon forming a line, visible at least in part on the simulated sundial, the line having a first end and a second end;

a first plurality of substantially linear electronic display circuit elements on the simulated sundial, along lines extending radially from the first end of the line formed by the gnomon toward the portion of the sundial with the representations of the hours;

a second plurality of substantially linear electronic display circuit elements on the simulated sundial, along lines extending radially from the second end of the line formed by the gnomon toward the portion of the sundial with the representations of the hours; and a control circuit for actuating at least one display circuit element from the first plurality and at least one display circuit element from the second plurality visibly illuminating a basically triangular display with one angle pointing toward a position on the portion of the sundial with the representations of the hours which position substantially represents the actual time whereby the activated elements act cooperatively with the gnomon to give the appearance of an actually functioning sundial.

2. An electronic timepiece according to claim 1, further comprising a digital auxiliary display visible on the face and having separate digital representations for minutes, tens of minutes, hours and tens of hours.

3. An electronic timepiece according to claim 2 wherein the control circuit comprises:

a conventional timepiece circuit for actuating the digital display to represent time; and a conversion circuit responsive to the time represented on the digital display for actuating the corresponding elements of the first and second pluralities to represent approximately the same time as actuated on the digital display.

4. An electronic timepiece according to claim 3 wherein the conversion circuit comprises:

a first circuit for converting the representations of hours and tens of hours into twelve outputs representing the hours of one through twelve;

a second circuit for converting the representation of tens of minutes into six outputs representing zero, ten, twenty, thirty, forty and fifty minutes after the hour; and a circuit for selecting which display circuit elements from each of the first and second pluralities to actuate to make a fully visible display based on outputs from the first and second circuits for converting.

5. An electronic timepiece according to claim 4 wherein each element of the first plurality terminates opposite the gnomon near the termination of one element of the second plurality forming a point at the ends of the elements opposite the gnomon and wherein the basically triangular display is formed before noon by actuating the elements of the first plurality from the element pointing to the correct time onward and actuating the elements of the second plurality up to the element pointing to the correct time and is formed after noon by actuating the elements of the first plurality up to the element pointing to the correct time and actuating the elements of the second plurality from the element pointing to the correct time onward.

6. An electronic timepiece according to claim 4 further comprising:

a visual indicator of whether the time is day or night; and the conversion circuit further comprises a circuit for resetting the selecting circuit and the visual indicator between night and day.

7. An electronic timepiece according to claim 6 wherein the visual indicator displays a crescent image to represent night and a substantially round solar image to represent day.

8. An electronic timepiece according to claim 1 further comprising a visual indicator of whether the time is day or night.

9. An electronic timepiece according to claim 8 wherein the visual indicator displays a crescent image to represent night and a substantially round solar image to represent day.

10. An electronic timepiece comprising in combination:

a face forming a simulated sundial with representations of hours visible in appropriate locations;

a gnomon forming a line, visible at least in part on the simulated sundial, the line having a first end and a second end;

a layer of liquid crystal;

a first plurality of substantially linear electronic display circuit elements on the simulated sundial, along lines extending radially from the first end of the line formed by the gnomon toward the portion of the sundial with the representations of the hours;

a second plurality of substantially linear electronic display circuit elements on the simulated sundial, along lines extending radially from the second end of the line formed by the gnomon toward the portion of the sundial with the representations of the hours; and a control circuit for actuating at least one display circuit element from the first plurality and at least one display circuit element from the second plurality visibly illuminating a basically triangular display with one angle pointing toward a position on the portion of the sundial with the representations of the hours which position substantially represents the actual time whereby the activated elements act cooperatively with the gnomon to give the appearance of an actually functioning sundial wherein one of the two pluralities of substantially linear electronic display circuit elements forms a layer below the liquid crystal and the other plurality forms a layer above the liquid crystal, and the circuit display elements of plurality below the liquid crystal is actuated by substantially grounding such elements, and the circuit display elements of the plurality above the liquid crystal are actuated by driving such elements at a voltage greater than zero in absolute value.

11. An electronic timepiece according to claim 10 wherein each element of the first plurality terminates opposite the gnomon near the termination of one element of the second plurality forming a point at the ends of the elements opposite the gnomon and wherein the basically triangular display is formed before noon by actuating the elements of the first plurality from the element pointing to the correct time onward and actuating the elements of the second plurality up to the element pointing to the correct time and is formed after noon by actuating the elements of the first plurality up to the element pointing to the correct time and actuating the elements of the second plurality from the element pointing to the correct time onward.

12. An electronic timepiece according to claim 11, further comprising a digital auxiliary display visible on the face and having separate digital representations for minutes, tens of minutes, hours and tens of hours.

13. An electronic timepiece according to claim 12 wherein the control circuit comprises:

a conventional timepiece circuit for actuating the digital display to represent time; and a conversion circuit responsive to the time represented on the digital display for actuating the corresponding elements of the first and second pluralities to represent approximately the same time as actuated on the digital display.

14. An electronic timepiece according to claim 13 wherein the conversion circuit comprises:

a first circuit for converting the representations of hours and tens of hours into twelve outputs representing the hours of one through twelve;

a second circuit for converting the representation of tens of minutes into six outputs representing zero, ten, twenty, thirty, forty and fifty minutes after the hour; and a circuit for selecting which display circuit elements from each of the first and second pluralities to actuate to make a fully visible display based on outputs from the first and second circuits for converting.

15. An electronic timepiece according to claim 14 further comprising:

a visual indicator of whether the time is day or night; and the conversion circuit further comprises a circuit for resetting the selecting circuit and the visual indicator between night and day.

16. An electronic timepiece according to claim 15 wherein the visual indicator displays a crescent image to represent night and a substantially round solar image to represent day.

17. An electronic timepiece according to claim 10 further comprising a visual indicator of whether the time is day or night.

18. An electronic timepiece according to claim 17 wherein the visual indicator displays a crescent image to represent night and a substantially round solar image to represent day.

* * * * *